United States Patent [19]

Patel et al.

[11] 4,394,929

[45] Jul. 26, 1983

[54] CRYOGENIC LIQUID STORAGE CONTAINER HAVING AN IMPROVED ACCESS CONDUIT

[75] Inventors: Nandlal P. Patel, Indianapolis, Ind.; Roger J. Dolida, Kingwood, Tex.

[73] Assignee: Union Carbide Corporation, Danbury, Conn.

[21] Appl. No.: 252,949

[22] Filed: Apr. 10, 1981

[51] Int. Cl.[3] ..... B65D 25/18; F17C 13/00

[52] U.S. Cl. ..... 220/421; 220/465; 220/901; 285/332

[58] Field of Search ..... 220/446, 465, 420, 421, 220/422, 423, 424, 425, 901; 137/376, 377, 375; 285/322, 189, DIG. 5; 29/455 R, 455 LM; 62/50, 51, 55, 5, 54

[56] References Cited

U.S. PATENT DOCUMENTS

| | | | |
|---|---|---|---|
| 38,112 | 4/1863 | Knight | 285/189 |
| 1,071,817 | 0/1913 | Stanley | 220/422 |
| 1,564,811 | 0/1925 | Anthon | 220/421 |
| 1,576,311 | 3/1926 | Grosset | 285/332 |
| 1,970,120 | 0/1934 | Badger | 220/10 |
| 2,195,077 | 0/1940 | Brown | 62/1 |
| 3,080,086 | 0/1963 | James | 220/15 |
| 3,331,522 | 0/1967 | Bridges | 215/13 |
| 3,583,429 | 6/1971 | Demarchais | 137/376 |
| 4,055,268 | 10/1977 | Barthel | 220/423 |
| 4,091,634 | 5/1978 | Shepherd | 62/55 |
| 4,120,421 | 10/1978 | Prost | 220/446 |
| 4,157,779 | 0/1979 | Ishii et al. | 228/176 |

FOREIGN PATENT DOCUMENTS

| | | | |
|---|---|---|---|
| 1188878 | 3/1965 | Fed. Rep. of Germany | 285/189 |

*Primary Examiner*—Allen N. Shoap
*Assistant Examiner*—Robert Petrik
*Attorney, Agent, or Firm*—Eugene Lieberstein

[57] ABSTRACT

A double-walled vacuum insulated cryogenic liquid container wherein the access conduit is composed of a material whose strength increases with decreasing temperature with the conduit having a wall thickness which varies in a manner such that when the container is holding a cryogenic liquid, the ratio of bending moment stress in the conduit due to a selected applied force to the strength of the conduit material is substantially constant along the length of the conduit.

1 Claim, 5 Drawing Figures

CRYOGENIC LIQUID STORAGE CONTAINER HAVING AN IMPROVED ACCESS CONDUIT

This invention relates to a double-walled vacuum insulated cryogenic liquid container. More particularly, this invention relates to a double-walled vacuum insulated cryogenic liquid container having an improved access conduit or neck tube.

BACKGROUND OF THE INVENTION

Double-walled vacuum insulated containers for the storage of cryogenic liquids are well known in the art. Containers of this type may be used, for example, to hold a liquid nitrogen refrigerant and function as a refrigeration unit for the storage of biological materials. Containers of this type are also used for the storage and dispensing of liquid oxygen for vaporization and use as breathing oxygen. Such containers are useful for a wide variety of purposes which require the storage and/or dispensing of a cryogenic liquid. Cryogenic liquids are generally considered to be liquids having a low boiling point at one standard atmosphere (760 mm Hg) with common examples being liquid nitrogen (77° K.), liquid oxygen (90° K.), liquid argon (87° K.), liquid hydrogen (21° K.), liquid helium (5° K.) and liquid air (80° K.).

Since cryogenic liquids have a very low heat of vaporation, even small quantities of thermal energy flowing from ambient into the liquid cryogen cause significant losses of cryogen through evaporation.

The prior art has thus devoted considerable effort in the design of double-walled vacuum insulated cryogenic liquid storage containers to minimize losses of cryogen due to heat inflow from the ambient. Accordingly, much progress has been made in the development of high performance container insulation systems to reduce the heat inflow from the ambient through the container insulation to the stored cryogen. These developments include:

Containers have been developed having evacuable insulation spaces capable of attaining and maintaining very low pressures on the order of less than 0.1 microns Hg when holding a cryogen.

Composite multilayered thermal insulations have been developed comprising radiation barrier materials interleaved with low heat conductive materials. Thermal insulations of this type are described, for example, in U.S. Pat. No. 3,007,596-Matsch, U.S. Pat. No. 3,009,600-Matsch; U.S. Pat. No. 3,006,601-Matsch; U.S. Pat. No. 3,145,515-Clapsadle; U.S. Pat. No. 3,265,236-Gibbon et al.; U.S. Pat. No. 4,055,268-Barthel; and U.S. Pat. No. 4,154,363-Barthel. An example of a composite multi-layered thermal insulation having one component comprising a metal coated organic plastic film is described in U.S. Pat. No. 3,018,016-Hnilicka.

A further prior art development in cryogenic storage container insulation systems is to dispose heat exchanger shields within the multilayered insulation and connect these shields to the neck tube of the container to conduct part of the thermal energy inflowing through the insulation through the neck tube wall into the cold effluent gas which carries it away to the surrounding atmosphere. Such an insulation system is described, for example, in U.S. Pat. Nos. 3,133,422-Paivanas et al. and 3,341,052-Barthel.

A recent improvement in cryogenic storage container insulation systems is to dispose a high thermally conductive member within the insulation for intercepting inflowing heat which is thermally joined to a thermal electric heat pump positioned within the insulation wherein the thermoelectric heat pump rejects the intercepted heat back to the ambient. Such a system is described in U.S. patent application Ser. No. 96,407 issued as U.S. Pat. No. 4,287,720 to Barthel.

Thus, the prior art has made many improvements in cryogenic container thermal insulation systems to reduce heat inflowing from the ambient into the liquid cryogen. However, thermal insulations and their optimization as a system are approaching the limit of efficiency beyond which further improvements result in negligible advantage or are not economically feasible.

Nevertheless, further reductions in heat inflowing from the ambient into the liquid cryogen stored in a cryogenic container is of great interest to the art.

Another path of heat inflow from the ambient into a liquid cryogen stored in a double-walled cryogenic container is provided by solid conduction through the container access conduit or neck tube. As is known in the art, the access conduit or neck tube penetrates the double-walled container's outer wall and inner vessel annd provides for ingress to and egress from the container's storage volume. The access conduit or neck tube also provides structural support for maintaining the container's inner vessel in a fixed spacial relationship with the outer wall or shell.

As double-walled cryogenic container insulations and their optimization as a system have approached very high efficiencies, the path of heat inflow by solid conduction through the neck tube has assumed greater significance in that it contributes a larger percentage of the total heat inflow from the ambient to the cryogen.

The prior art approach to minimize the heat inflow through the neck tube path has been generally to employ relatively elongated conduits. The purpose of the elongated conduit is primarily to increase the length of the path over which the inflowing heat must travel. However, this approach is limited by structural considerations. As the length of the access conduit or neck tube is increased to reduce heat leak, the thickness of the access conduit wall member must be increased in order to support the increased bending moment to which the access conduit is subjected to due to increased length. Increase of the access conduit wall member thickness will increase the heat transfer from the ambient into the stored cryogen by solid conduction through the neck tube or access conduit since this heat transfer mechanism is directly proportional to the cross-sectional area of the conduction path.

Accordingly, the art has been searching for an improved double-walled cryogenic liquid container access conduit design to decrease heat inflow from the ambient by solid conduction through the access conduit into a stored liquid cryogen.

OBJECT OF THE INVENTION

It is therefore an object of the present invention to provide a double-walled container for the storage of cryogenic liquids having an improved access conduit in order to reduce heat inflow into the container storage volume by way of solid conduction through the access conduit.

It is a further object of the present invention to provide a double-walled container for the storage of cryogenic liquids having an improved access conduit in order to reduce heat inflow into the container storage volume by way of solid conduction through the access conduit without adversely affecting the structural integrity of the container.

It is, moreover, an object of the present invention to provide a double-walled container for the storage of a cryogenic liquids having a state of the art high efficiency thermal insulation system which will have an improved normal evaporation rate and an increased holding time for a stored cryogenic liquid resulting from an improved access conduit which is structurally simple, easy to fabricate, inexpensive, and readily adaptable for incorporation into existing container designs.

These and other objects will be apparent from the following description and claims in conjunction with the drawings.

SUMMARY OF THE INVENTION

The present invention may be generally summarized as:

a cryogenic liquid container having an inner vessel for holding a cryogenic liquid;

an outer shell surrounding said inner vessel arranged and constructed with respect to said inner vessel so as to form an evacuable space therebetween;

thermal insulation material disposed in said evacuable space;

a conduit penetrating said inner vessel and said outer shell to provide for egress from and ingress to said inner vessel with said conduit being gas tightly joined to said inner vessel and said outer shell and providing structural support for said inner vessel;

the improvement in which comprises:

said conduit being composed of a material having a strength that increases with decreasing temperature and said conduit having a wall thickness which varies in a manner such that when said inner vessel is holding a cryogenic liquid the ratio of bending moment stress in said conduit due to a selected applied force to said strength of said conduit material is substantially constant along the length of said conduit between the juncture of said conduit with said outer shell and the juncture of said conduit with said inner vessel.

In one preferred embodiment of the present invention, the access conduit will have a wall thickness which is gradually reduced along the length of the access conduit from a point proximate to the juncture of the access conduit with the container outer shell to a point proximate to the juncture of the access conduit with the inner vessel.

In another preferred embodiment of the present invention, the container further comprises trunnion means positioned within the evacuable space for restraining movement of the inner vessel with respect to the outer shell and the access conduit will have a wall thickness which is gradually reduced along the length of the access conduit from a point proximate to the juncture of the access conduit with the outer shell to a point along the length of the access conduit intermediate to the junctures of the access conduit with the outer shell and the inner vessel with the conduit wall thickness gradually increasing along the length of the conduit from this intermediate point to a point proximate to the juncture of the access conduit with the inner vessel.

As used herein, a point along the length of the access conduit proximate to the juncture of the access conduit with the outer shell or inner vessel means a point along the length of the access conduit at or near the respective juncture.

DESCRIPTION OF THE PREFERRED EMBODIMENT

In order to afford a complete understanding of the present invention and an appreciation of its advantages, a description of the preferred embodiments is presented below.

Figure 1:
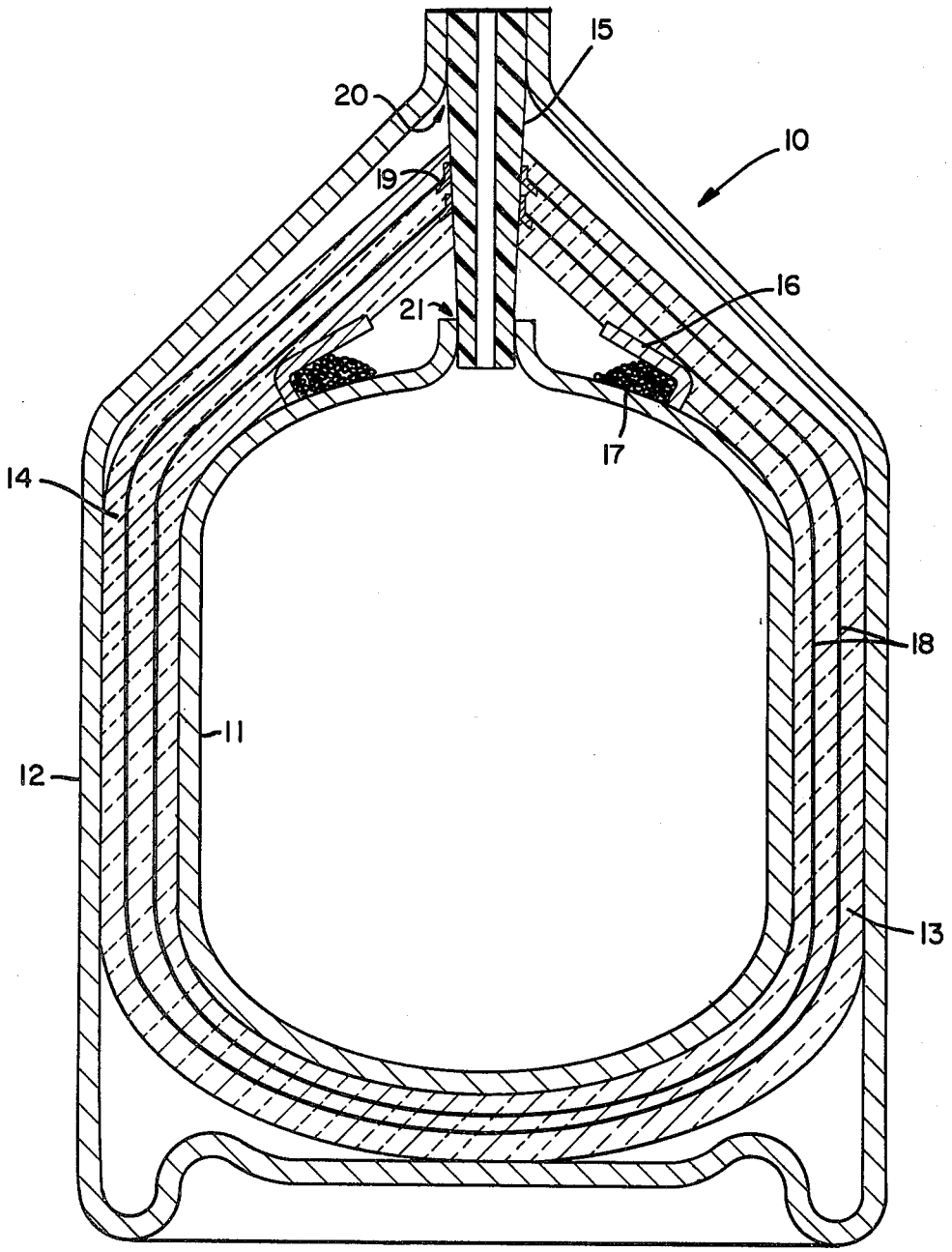
FIG. 1 is a schematic cross-sectional view in elevation of a non-trunnioned double-walled cryogenic liquid container having an improved access conduit in accordance with a particular embodiment of the present invention.

Referring to FIG. 1, illustrated therein is a double-walled evacuable cryogenic liquid container 10 in accordance with one embodiment of the present invention. Container 10 comprises an inner vessel 11 providing a storage volume for receiving a cryogenic liquid. Container 10 further comprises an outer shell or wall 12 which surrounds and is spaced from inner vessel 11 to form evacuable space 13. Thermal insulation material 14 suitable for use in cryogenic service is disposed in and substantially fills evacuable space 13.

Access conduit 15 penetrates outer shell 12 and inner vessel 11 to provide for ingress to and egress from the storage volume provided by inner vessel 11. Access conduit 15 is gas tightly joined about its circumference to inner vessel 11 and outer shell 12, e.g., by magneforming, adhesive joining, welding or mechanical swaging, so as to maintain the vacuum integrity of evacuable space 13. Access conduit 15 provides support and lateral stability for inner vessel 11 and thus maintains the spaced relationship of the inner vessel 11 with respect to the outer shell 12. In the embodiment illustrated in FIG. 1, trunnion type means are not provided for further restraining movement of inner vessel 11 with respect to outer shell 12.

The container illustrated in FIG. 1 is thus one of the type wherein access conduit 15 has a substantially vertical orientation and penetrates the container inner vessel 11 and outer shell 12 at the top end of the container at approximately the center line of the container when the container is in an upright position.

It is desirable for the container 10 to further comprise an adsorbent retainer 16 holding an adsorbent material 17, e.g., type 5A molecular sieve manufactured by Union Carbide Corporation, New York, N.Y., for maintaining a vacuum in the evacuable space 13. A gettering material, e.g., PdO, is also desirably disposed in the evacuable space (not shown), advantageously, in the region near the outer shell 12, to assist in vacuum maintenance.

The outer shell 12 is suitably provided with an appropriate fitting (not shown) for connection with a vacuum pump for drawing a vacuum in evacuable space 13.

The pressure in evacuable space 13 is suitably less than about 50 microns of mercury with pressures of less than about 0.1 microns of mercury when the container is holding a cryogen being typically employed.

Composite multilayered insulations comprising alternate layers of radiation barrier materials and low heat conductive material of the types described in the hereinbefore referenced U.S. patents are advantageously employed as thermal insulation material 14.

Heat conductive shields 18 of the type disclosed in U.S. Pat. Nos. 3,133,422 - Paivanas et al. and 3,341,052 - Barthel may be advantageously disposed within the thermal insulation material 14 so as to surround inner vessel 11 at intervals across evacuable space 13. Heat conductive shields 18 are thermally joined to access conduit 15, for example, by frusto-conical members 19, and thus conduct a portion of the thermal energy in flowing through the thermal insulation 14 into cold effluent gas egressing through the access conduit as described in U.S. Pat. Nos. 3,133,422 and 3,341,052.

The heat conductive shields 18 are typically thin, non-self supporting, flexible, highly conductive metal (for example, aluminum foil layers) and are coextensive with and supported by the multilayered thermal insulation 14. The heat conductive shields are thermally joined by a low thermal resistance connection to access conduit 15 in order to take advantage of the sensible refrigeration available in the effluent gas egressing through the access conduit 15. That is, the effluent gas, caused by evaporation of a stored liquid cryogen, is a heat absorbing fluid egressing from the inner vessel 11. These heat conducting shields 18 are secured to the access conduit by the low thermal resistance connection 19 at a region where the temperature is lower than the temperature assumed by the shields 18 absent the securing so as to transfer heat from the shields 18 to the access conduit 15 and hence to the egressing effluent fluid. Such shields are not necessary for the practice of the present invention but are advantageous for a high efficiency thermal insulation design.

In accordance with a particular embodiment of the present invention as illustrated in FIG. 1, access conduit 15 has a wall thickness which is gradually reduced in a linear manner along the length of access conduit 15 from a point proximate to the juncture 20 of conduit 15 with the outer shell 12 to a point proximate to the juncture 21 of conduit 15 with the inner vessel 11. Furthermore, in accordance with the present invention, access conduit 15 is composed of a material whose strength increases with decreasing temperature. The material of which access conduit 15 is composed suitably has a low thermal conductivity.

Examples of advantageous materials for fabrication of access conduit 15 include plastics such as NEMA (National Electrical Manufacturers Association) G-10CR and G-11CR; fiber reinforced plastics suitable for injection molding; and stainless steel such as types 304 and 306. Such materials have suitable characteristics of structural strength, low thermal conductivity and low gas permeability which are desirable for access conduit or neck tube fabrication.

The present invention is predicated upon the discovery that a cryogenic liquid container access conduit having a variable wall thickness, in accordance with the present invention, will reduce conductive heat inflow from the ambient surrounding the container into the container inner vessel holding a cryogenic liquid, and that this may be accomplished without impairing the structural integrity of the container. This discovery results in reducing heat inflow from the ambient into a liquid cryogen stored in a cryogenic liquid container having a optimized, highly efficient, state of the art insulation system in a structurally simple and economical manner. The discovery of the present invention is based on the recognition of the interrelation of the following factors which may be exploited to reduce conductive heat transfer through the access conduit into a stored liquid cryogen, and which results in significantly reducing the evaporation of a liquid cryogen stored in a container having an efficient state of the art insulation system without impairing the structural integrity of the container.

The bending moment along the length of the access conduit decreases along the length of the access conduit proceeding from the juncture of access conduit with the container outer shell toward the container inner vessel. That is, bending moment which must be withstood by the access conduit without exceeding the strength of the access conduit material is greatest in the region of the access conduit near or proximate to the juncture of the access conduit with the container outer shell and least in the region of the access conduit near or proximate to the juncture of the access conduit with the container inner vessel. Furthermore, bending moment may be generally described as decreasing in a substantially linear manner along the length of the access conduit from a point or location proximate to the juncture of the access conduit with the container outer shell to a point or location near the juncture of the access conduit with the inner vessel.

Figure 2:
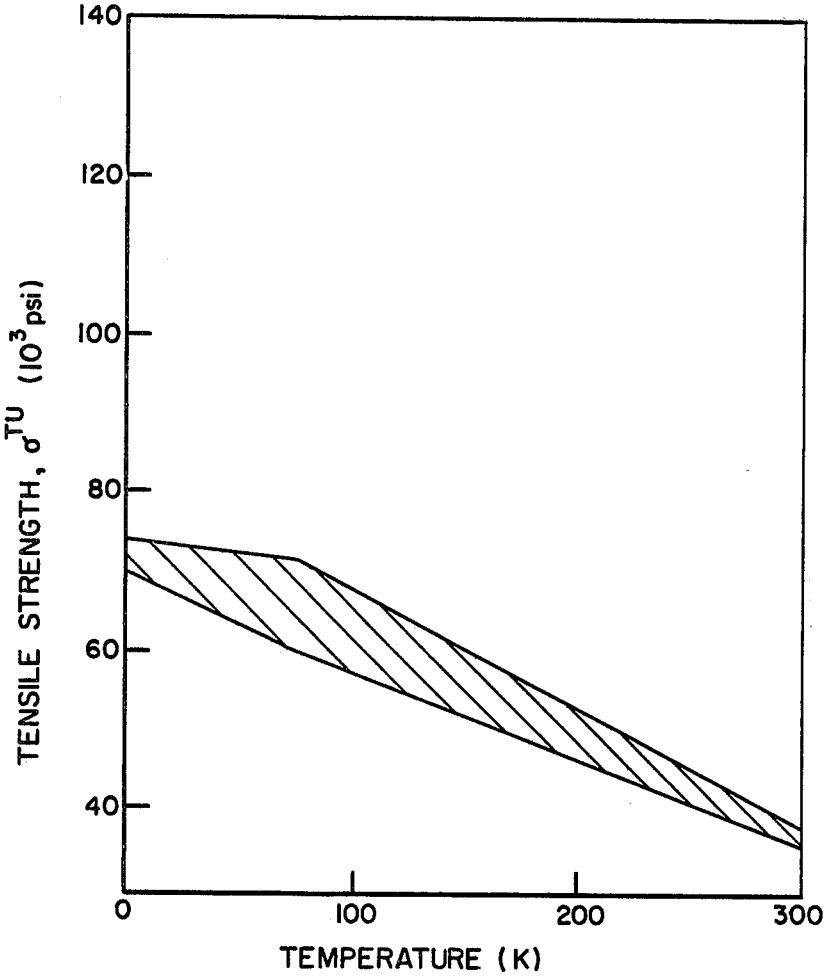
FIG. 2 is a graph illustrating the change in tensile strength as a function of temperature for NEMA Grade 10CR glass-epoxy plastic (in the fill direction) (error bands show upper and lower data spreads) which is a typical access conduit material for the improved access conduit in accordance with present invention in a container such as illustrated in FIG. 1.
Figure 5:
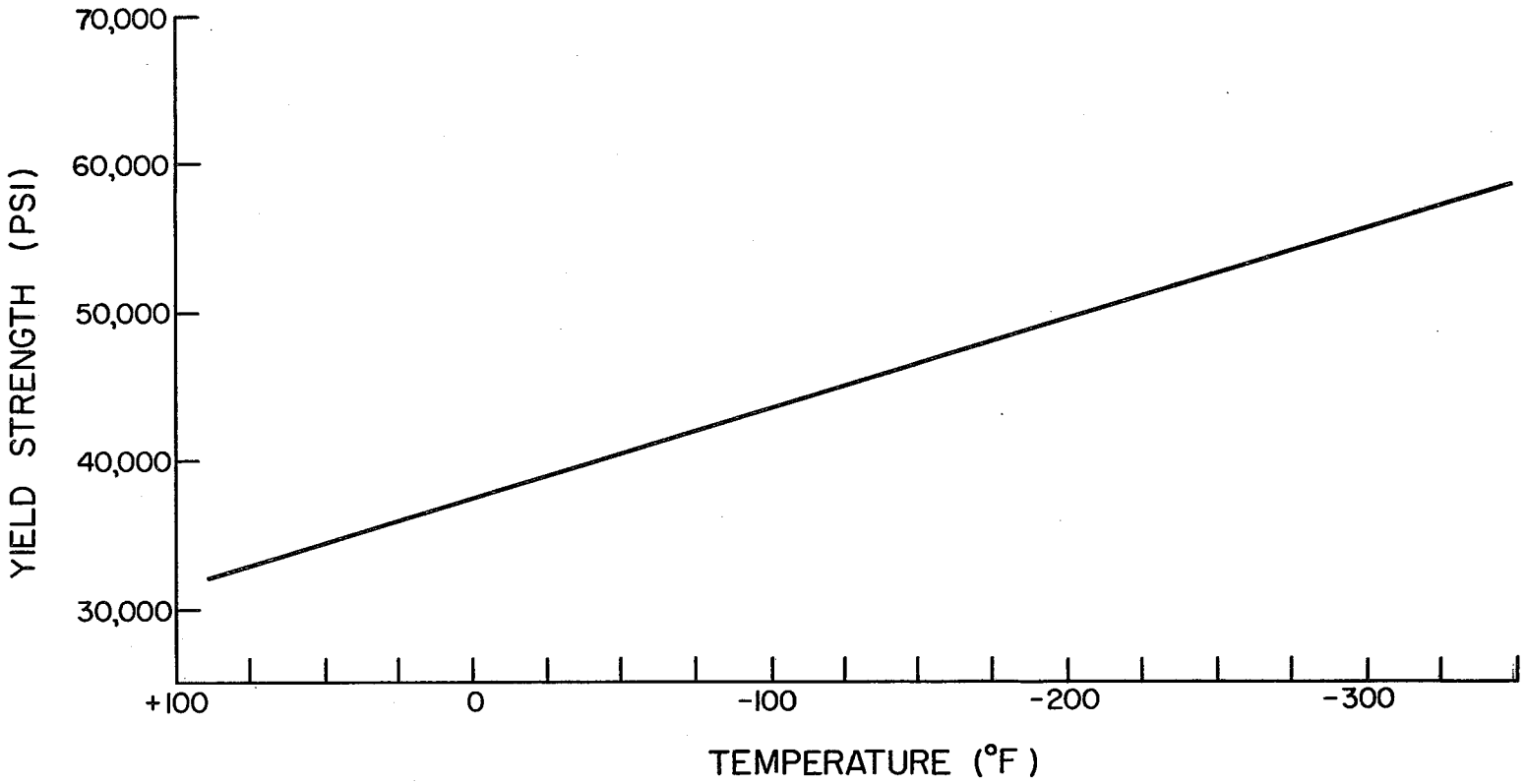
FIG. 5 is a graph illustrating the change in yield strength (0.2 percent offset) as a function of temperature for type 304 stainless steel which is a typical access conduit material for the improved access conduit in accordance with the present invention in a container such as illustrated in FIG. 4.

Strengths of materials which may be employed for the fabrication of access conduits, such as plastics and stainless steel, increase with decreasing temperature as illustrated in FIGS. 2 and 5.

In any cryogenic storage container, the access conduit is exposed to a very sizeable temperature gradient. The portion of the access conduit proximate the inner vessel will be near cryogenic temperatures when the container is holding a cryogenic liquid. That is, the portion of the access adjacent to the inner vessel and any portion of the access conduit which may extend into the inner vessel storage volume will assume a temperature which is approximately the temperature of the stored cryogenic liquid. In contrast, the portion of the access conduit adjacent to the outer shell and any portion of the access conduit which may extend out from the outer shell into the ambient will assume approximately the ambient temperature. Hence, the access conduit will be exposed to a temperature gradient which will vary along the length of the conduit from a temperature of approximately the temperature of the stored liquid cryogen at a point on the access conduit adjacent to the inner vessel to a temperature of approximately the ambient temperature at a point on the access conduit adjacent to the outer shell.

If the access conduit is fabricated from the same material with a constant wall thickness over its length between a point adjacent to the outer shell and a point adjacent to the inner vessel, one skilled in the art will appreciate that the temperature of the access conduit will decrease in an approximately linear manner along the length of the access conduit from the outer shell to the inner vessel in accordance with the well known principles of solid conductive heat transfer in solid materials. It is recognized, of course, that there will be variations in the linear temperature gradient in the access conduit due to factors such as the presence of the effluent fluid caused by evaporation of the stored liquid cryogen egressing the container via the access conduit; the use of the hereinbefore described heat conductive shields 18 thermally joined to the access conduit; and conduction paths through aluminum foil layers of a composite multilayered insulation. These variations in temperature gradient along the length of the access conduit do not change the general principles or improved results of the access conduit in accordance with the present invention. Similarly, if the material from which the access conduit was fabricated changed along the length of the conduit between the outer shell and inner vessel and thus the thermal conductivity of the access conduit changed, the general principles and improved results of the access conduit in accordance with the present invention would still hold.

The sizeable temperature gradient to which a cryogenic storage container access conduit is exposed will be more readily appreciated by considering the following example. Consider a cryogenic storage container holding liquid nitrogen at one atmosphere pressure. The temperature of liquid nitrogen saturated at this pressure is about 77° K. (−196° C.) (−320° F.). Accordingly, the portion of the access conduit adjacent to the container inner vessel will assume a temperature of approximately about 77° K. (−196° C.) (−320° F.). In contrast, the portion of the access conduit adjacent to the container outer shell will assume approximately the ambient temperature surrounding the container, say, for example, 273° K. (0° C.) (32° F.) or greater.

Assume the access conduit is fabricated from NEMA G-10CR glass-epoxy plastic. Referring to FIG. 2, the tensile strength of this material is about 60,000 psi, at 77° K. and about 38,000 psi at 273° K. (taking the lower range of the tensile strength from FIG. 2 for conservative design purposes). Accordingly, the tensile strength of the conduit material adjacent to the inner vessel has increased about 58 percent with respect to the tensile strength of the conduit material adjacent to the outer shell.

As hereinbefore discussed, the temperature of the access conduit will decrease in an approximately linear manner along the length of the access conduit from a point adjacent to the outer shell to a point adjacent to the inner vessel. Referring to FIG. 2, it is seen that the tensile strength of the type NEMA G-10CR glass-epoxy plastic increases in a substantially linear manner with respect to decreasing temperature. Hence, the tensile strength of the access conduit fabricated from the NEMA G-10CR epoxy-glass plastic will increase in an approximately linear manner along the length of the access conduit from a point adjacent to the outer shell to a point adjacent to the inner vessel.

Figure 3:
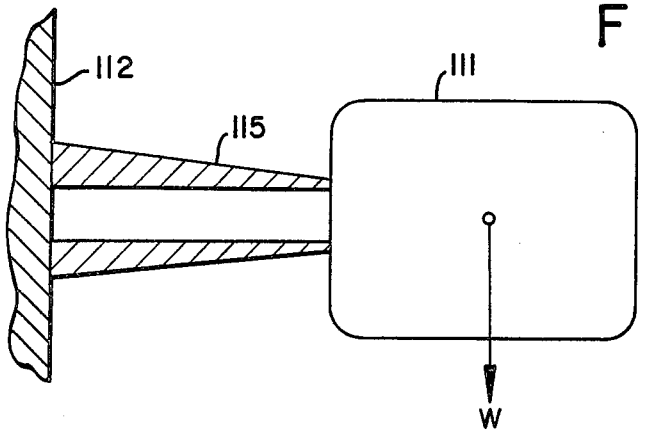
FIG. 3 is a simplified schematic loading diagram for a load inducing bending moment in an access conduit in a non-trunnioned container of the type illustrated in FIG. 1.

Assume now that the container is a non-trunnioned container of the type illustrated in FIG. 1. Referring to FIG. 3, it can be seen that the bending moment along the length of the access conduit may be approximated by the bending moment for a cantilever beam. Apparatus elements in FIG. 3 corresponding to those previously discussed with respect to FIG. 1 are given the same reference numeral increased by 100. In FIG. 3, the relevant components are the inner vessel 111, the access conduit 115 and the outer shell 112. Support of the inner vessel with respect to the outer shell by the insulation material may be ignored. In most designs, the access conduit is selected to provide structural support of the inner vessel so as to prevent large deflections of the inner vessel with respect to the outer shell. Accordingly, the insulation is not crushed by deflections of the inner vessel.

The force W which causes the access conduit to be subjected to bending moment may be, for example, due to the component of force perpendicular to the central or longitudinal axis of the conduit due to tipping of the container or rough handling.

Since the bending moment in the access conduit of a non-trunnioned container is approximated by a cantilever beam, it will be recognized that the loading to which the access conduit will be subjected due to bending moment will decrease in an approximately linear manner along the length of the access conduit from a point adjacent to the outer shell to a point adjacent to the inner vessel.

Interrelating the foregoing factors, an access conduit is provided in accordance with the present invention which will reduce heat inflow from the ambient surrounding the outer shell of the container to the inner vessel holding a cryogenic liquid without impairing the structural integrity of the container by providing an access conduit having a wall thickness which varies in a manner such that when the inner vessel is holding a cryogenic liquid, the ratio of the stress in the conduit due to bending moment from a selected applied force to the strength of the conduit material will be substantially constant along the length of the access conduit between the juncture of the access conduit with the outer shell and the juncture of the access conduit with the inner vessel.

Stated otherwise, the ratio of stress due to bending moment from a selected applied force to the access conduit material strength at a first selected point along the length of the access conduit between the juncture of the conduit with the outer shell and the junction of the conduit with the inner vessel will be substantially equal to the ratio of the stress due to bending moment from the selected applied force to the conduit material strength at any second selected point along the length of the access conduit between the juncture of the conduit with the outer shell and the juncture of the conduit with the inner vessel.

This may be restated in terms of the well known flexure formula:

$$\sigma = Mc/I$$

where: $\sigma$=stress; M=bending movement; c=the distance from the neutral axis of the access conduit to the outer perimeter of the access conduit; and I equals the moment of inertia of a cross-section of the access conduit about the neutral axis. As the bending moment M changes along the length of the conduit between the outer shell and the inner vessel, the wall thickness of the access conduit is varied along the length of the conduit [and hence c and I are varied] so as to maintain the ratio of the stress due to bending moment $\sigma$ in the access conduit to the strength of the conduit material which is increasing along the length of the access conduit from the juncture with the outer shell to the juncture with the inner vessel substantially constant.

It is recognized that the access conduit will also be subjected to stress due to shear force and direct tension load. However, the stresses due to shear force and the direct tension are small relative to the stress due to bending moment and may, as a practical matter, be neglected in the design of the access conduit wall thickness.

The access conduit 15 of container 10 of FIG. 1 [in accordance with a particular embodiment of the present invention] illustrates the present invention. The access conduit 15 of FIG. 1 has a tubular or hollow cylindrical shape with a constant inner diameter and a variable outer diameter, thus providing an access conduit with a variable wall thickness. The wall thickness of the access conduit of FIG. 1, as shown, is exagerated for purposes of this illustration.

The wall thickness of access conduit 15 of FIG. 1 is thickest at the juncture of access conduit 15 with outer shell 12 since, as hereinbefore discussed, the bending moment is greatest at this juncture. Moreover, the strength of the access conduit material is less at the juncture of the access conduit 15 with outer shell 12 than the strength at the juncture of access conduit 15 with inner vessel 10.

The wall thickness of access conduit 15 of FIG. 1 is thinest at the juncture of access conduit 15 with inner vessel 11 since, as hereinbefore discussed, the bending moment is less at the juncture of access conduit 15 with the inner vessel 11 than the bending moment at the juncture of access conduit 15 with the outer shell 12. Moreover, the strength of the access conduit 15 at the juncture with outer shell 12 is less than the strength at the juncture of access conduit 15 with inner vessel 10.

Assuming that the access conduit 15 is fabricated from NEMA G-10CR glass-epoxy plastic, and since the tensile strength of the plastic increases substantially linearly along the length of the access conduit from the outer shell to the inner vessel due to decreasing temperature and the bending moment along the length of the conduit decreases substantially linearly from the outer shell to the inner vessel, the ratio of the stress due to bending moment to the strength of the conduit material may be kept substantially constant by gradually reducing the thickness of the access conduit wall along the length of the access conduit from the outer shell to the inner vessel.

It will be apparent to one skilled in the art that in accordance with the present invention, any ratio desired may be chosen to provide the desired conduit strength required for a particular design. This ratio is essentially the desired factor of safety for a selected maximum design load. The strength level of the access conduit, in accordance with the present invention, has been substantially equalized along its length.

Accordingly, the average thickness of the access conduit has been reduced without impairing the structural integrity of the container. That is, in accordance with the present invention, whatever strength level is desired for the access conduit by a particular design requirement can be obtained with the average thickness of the access conduit wall being reduced.

Reducing the average thickness of the access conduit wall will reduce heat inflow due to solid conduction in the access conduit from the ambient into the inner vessel holding a cryogenic liquid as will hereinafter be demonstrated by the examples.

One skilled in the art will find it advantageously to vary the access conduit wall thickness by maintaining the inner diameter of the wall member constant along the length of the access conduit and varying the outer diameter along the length of the conduit because of ease of machining. However, if desired, the outer diameter may be kept constant and the inner diameter varied or both the inner and outer diameters could be varied.

The access conduit suitably has the shape of a tube or hollow cylinder but other geometrical cross-sectional shapes may be used.

Access conduit materials may have strengths which increase with decreasing temperatures in a non-linear manner. The access conduit wall thickness may still be gradually varied accordingly for an exact matching of the conduit material strength variation with the temperature gradient to the bending moment along the length of the conduit.

From a practical view point, an access conduit 15 wall thickness may be gradually reduced in a linear manner (as illustrated in the embodiment of FIG. 1) from a maximum thickness at or near the juncture of the access conduit with the outer shell to a minimum thickness at or near the juncture of the access conduit with the inner vessel. The benefits of the invention will still be achieved in that heat inflow into the inner vessel from the ambient due to solid conduction in the access conduit will be reduced without impairing the structural integrity of the container. That is, similar results will be achieved with fabrication and design being greatly simplified.

One skilled in the art will appreciate that the access conduit wall thickness, in accordance with the present invention, will be typically designed, for example, on the basis of tensile strength for plastic type materials and yield strength for stainless steel type materials. The strength criteria appropriate for structural design considerations for a particular material selected for the fabrication of the access conduit does not effect the principles and results achieved in accordance with the present invention.

Figure 4:
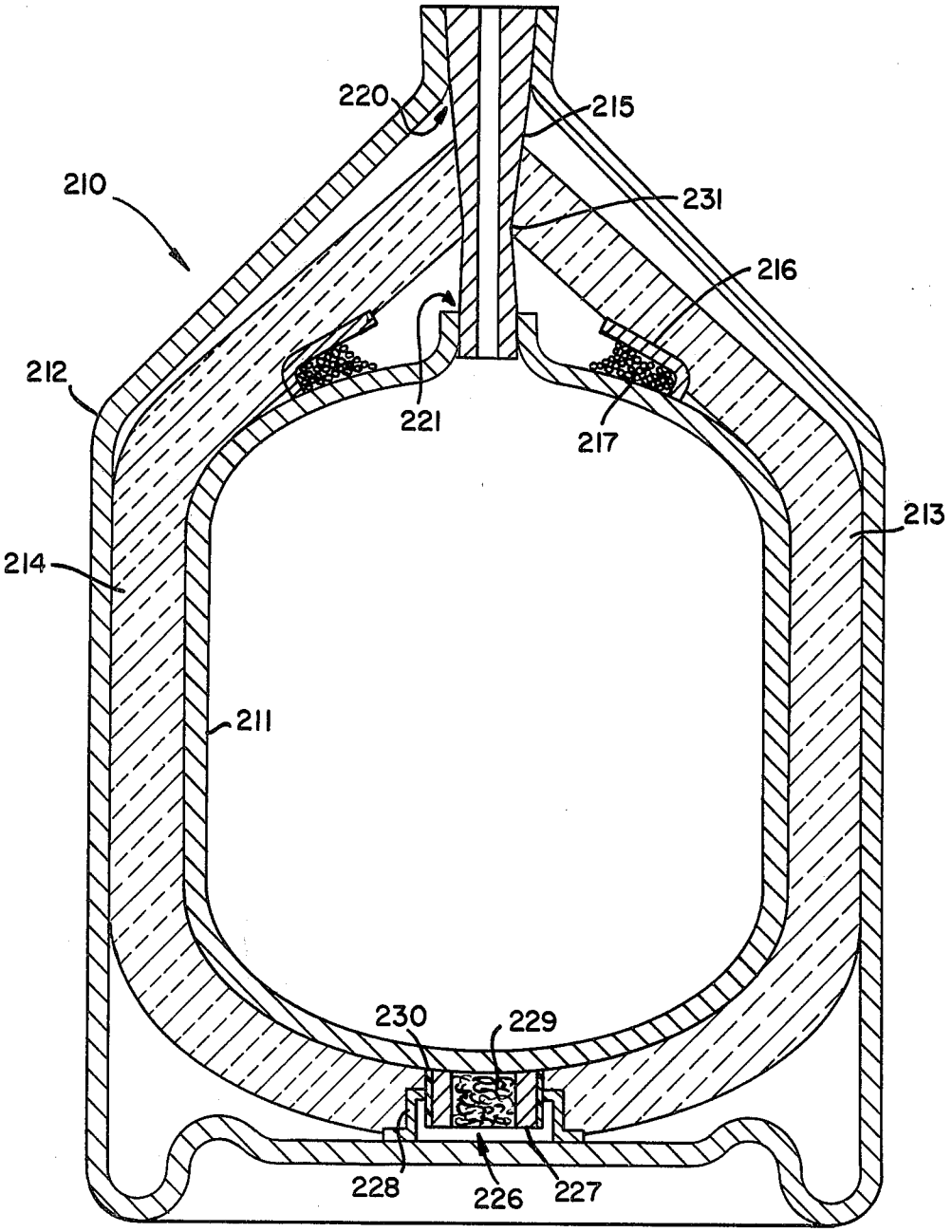
FIG. 4 is a schematic cross-sectional view in elevation of a trunnioned double-walled cryogenic liquid container having an improved access conduit in accordance with a different embodiment of the present invention.

FIG. 4 illustrates a trunnioned cryogenic liquid storage container 210 in accordance with another embodiment of the present invention. Apparatus elements corresponding to those previously discussed with respect to the FIG. 1 embodiment are given the same reference number increased by 200. Container 210 comprises an inner vessel 211 and an outer shell 212 surrounding and spaced from inner vessel 211 so as to form evacuable space 213 therebetween. Thermal insulation material 214 suitable for use in cryogenic service such as a composite multilayered insulation is disposed in and substantially fills evacuable space 213.

Access conduit 215 penetrates and is gas tightly joined to outer shell 212 and inner vessel 211 to provide for ingress to and egress from the storage volume provided by inner vessel 211. Access conduit 215 provides for support and lateral stability of inner vessel 211 and thus provides structural support for maintaining the spaced relationship of the inner vessel 211 with respect to the outer shell 212.

In the embodiment illustrated in FIG. 4, the trunnion means 226 comprises a hollow tubular column 227 joined to and extending downwardly from the bottom of the inner vessel 211 into evacuable space 213 but not touching outer shell 212. Movement of tubular column 227 is restricted by trunnion support member 228 which is joined to outer shell 212 and which surrounds but is not structurally joined to tubular column 228. Heat transfer through the trunnion means 226 is restricted by a low thermally conductive material 229, such as glass fibers, which is loosely packed into hollow tubular column 227 and by heat shrinkable thermal insulation tubing 230 surrounding tubular column 227 which increases the heat transfer resistance between the trunnion support member 228 and tubular column 227. The trunnion means illustrated in FIG. 4 primarily provides lateral support, i.e., restrains lateral movement of inner vessel 221 with respect to outer shell 212. However, trunnion means may be adapted to provide both lateral and vertical support for the inner vessel of a container.

Container 210 is also provided with an adsorbent retainer 216 holding an adsorbent material 217, e.g., type 5 A molecular sieve.

In accordance with this embodiment of the present invention, access conduit 215 has a wall thickness which is gradually reduced along the length of access conduit 215 from a point proximate to the juncture 220 of access conduit 215 with the outer shell 212 to a point 231 along the length of the access conduit 215 intermediate to the juncture 220 of the access conduit 215 with the outer shell 212 and the juncture 221 of the access conduit 215 with the inner vessel 211. The access conduit wall thickness then gradually increases along the length of the access conduit from intermediate point 231 to a point proximate to the juncture 221 of access conduit 215 with inner vessel 211.

A trunnioned container access conduit may be constructed of a high strength, low thermally conductive material such as stainless steel to insure it withstands rough handling. As before, the strength of the conduit material increases with decreasing temperature.

The trunnioned container access conduit has a wall thickness that varies in a manner such that when the inner vessel is holding a cryogenic liquid, the ratio of the stress in the access conduit due to bending moment from a selected applied force to the strength of the conduit material will be substantially constant along the length of the access conduit between the juncture of the access conduit with the outer shell and the juncture of the access conduit with the inner vessel.

The point of minimum bending moment and hence the point of minimum conduit wall thickness is intermediate to the juncture of the access conduit with the outer shell and the inner vessel, since the bending moment may be approximated by the bending moment for a cantilever beam having a simple support at the end of the beam opposite the end having the cantilever moment resistant support. As will be appreciated by one skilled in the art, the bending moment along the length of the access conduit for the trunnioned container will be a maximum adjacent to the juncture of the access conduit with the outer shell and will decrease in substantially linear manner along the length of the access conduit proceeding toward the inner vessel. In the vast majority of trunnioned container designs, the point of minimum bending moment along the length of the access conduit will be intermediate to the juncture of the access conduit with outer shell and the juncture of the access conduit with the inner vessel. After this point of minimum bending moment, the bending moment will gradually increase in a substantially linear manner to the juncture of the access conduit with the inner vessel.

For trunnioned container designs where the point of minimum bending moment along the access conduit is not intermediate to the juncture of the access conduit with the outer shell and the inner vessel, the point of minimum bending moment along the length of the access conduit will be at the juncture of the access conduit with the inner vessel.

As before, if the strength of the conduit material varies in a non-linear manner with temperature, the thickness of the conduit wall may be still gradually varied accordingly to achieve an exact matching of the strength of the conduit material to the bending moment.

As before, one skilled in the art will find it suitable to gradually vary the wall thickness in a linear manner as illustrated in FIG. 4. The beneficial results of the present invention will be achieved and fabrication and design will be simplified. Similarly, if a particular trunnioned container design establishes complex stress patterns, due, for example, to the location or the number of trunnions employed, one skilled in the art, if desired, may simplify design and fabrication procedures by selecting a point of maximum and minimum wall thickness and then vary the wall thickness linearly with respect to these points and still achieve substantial benefits in accordance with the present invention.

In trunnioned containers where the point of minimum bending moment along the length of the conduit is intermediate to the juncture of the access conduit with the outer shell and the inner vessel, one skilled in the art may desire, for fabrication convenience, to select the wall thickness of a point along the length of the access conduit proximate to the juncture of the access conduit with the inner vessel as the point of minimum access conduit wall thickness. The wall thickness of the access conduit may be then gradually varied in a linear manner from the point of maximum wall thickness at or near the juncture of the conduit with the container outer shell to the selected point of minimum wall thickness at or near the juncture of the access conduit with the inner vessel and, in many instances, enjoy substantial benefits in reducing heat inflow into the inner vessel in accordance with the present invention.

The access conduit 215 of FIG. 4 has a tubular or hollow cylindrical shape which has a constant inner diameter and a variable outer diameter along the length of the conduit which is convenient to fabricate. Moreover, a constant inner diameter may reduce heat inflow by way of the annular gap between an access conduit plug and the access conduit inner wall surface. However, the outer diameter may be held constant and the inner diameter varied along the length of the conduit or both the inner and outer diameters may be varied. Access conduits having other geometrical shapes may be used.

The size of the inner diameter of the access conduit is typically determined by the intended use of the cryogenic container.

To more fully illustrate the present invention and to gain a further appreciation of its advantages, the following examples are set forth.

EXAMPLE I (Prior Art)

Four prior art, non-trunnioned, double-walled vacuum insulated cryogenic containers having an aluminum outer shell surrounding a cylindrical aluminum inner vessel were fabricated for testing. The inner vessel had a 13.9 inch outer diameter, a 13.75 inch inner diameter and about a 15 inch length yielding a storage capacity of about 29 liters. A tubular shaped access conduit fabricated from NEMA G-10CR plastic was joined to the inner vessel and the outer shell and provided structural support for the inner vessel. The plastic access conduit was 8.0 inches long and had a 2.092 inch outer diameter and a 2.0 inch inner diameter.

The inner vessel was wrapped with 1.4 inches of a high quality composite multilayered thermal insulation of the type described in U.S. Pat. No. 3,265,236. The insulation characteristics are listed in Table IA.

TABLE IA

| | |
|---|---|
| Glass Fiber Diameter | 0.00174 inch (maximum) |
| Glass Fiber Specific Weight | 0.83 gm/ft$^2$ |
| Type of Foil | Aluminum |
| Foil Thickness | 0.000275 inches (nominal) |
| Layers per Inch | Approx. 40 |

Three heat shields, as hereinbefore described, were employed being disposed in the thermal insulation material at intervals of about 12 percent, 33 percent, and 62 percent of the insulation thickness, respectively, proceeding from the inner vessel toward the outer shell.

The pressure (i.e., vacuum) in the container's evacuable space was less than 0.1 microns ($1\times10^{-6}$ m.) mercury.

These containers are representative of state of the art high performance cryogenic liquid containers.

Liquid nitrogen was introduced into each of the containers and the normal evaporation rae (NER) was measured.

The procedure for determining the NER was as follows: Each of the four containers is initially filled with saturated liquid nitrogen at ambient atmospheric pressure (about 10 liter liquid nitrogen) and weighed after seven days when equilibrium conditions can be assured of being established. The containers were reweighed after three additional days. Reweighing of the containers then took place at three additional 3 day time periods to determine the NER in pounds per day, i.e., the pounds of liquid nitrogen evaporated in a one day time period, by determining the difference between the initial weight and the final weight during each time period.

The results of the NER testing for these four containers are tabulated in Table IB. Container 4 was removed for structural testing after measurement of the second NER.

TABLE IB

| | NER Performance Prior Art Containers | | | |
|---|---|---|---|---|
| Container No. | 1st NER Over 3 Days (lbs/day) | 2nd NER Over 3 Days (lbs/day) | 3rd NER Over 3 Days (lbs/day) | 4th NER Over 3 Days (lbs/day) |
| 1 | 0.20 | 0.1933 | 0.1933 | 0.1849 |
| 2 | 0.20 | 0.20 | 0.20 | 0.199 |
| 3 | 0.2167 | 0.2067 | 0.2067 | 0.1948 |
| 4 | 0.2267 | 0.2267 | — | — |
| Average | 0.2109 | 0.2067 | 0.200 | 0.1929 |

The average NER over the entire test was 0.2035 lbs/day for the prior art containers. Since the container has a 29 liter capacity (51.7 pounds liquid nitrogen), the average holding time for the prior art container is 254 days.

EXAMPLE II (Present Invention)

Four non-trunnioned containers in accordance with the present invention were fabricated for testing, differing from the four prior art containers of Example I only in having an access conduit in accordance with the present invention. The access conduits of the containers in accordance with the present invention were fabricated from NEMA G-10CR glass-epoxy plastic as were the access conduits in the four prior art containers of Example I. The access conduits in the containers in accordance with the present invention had a length of 8.0 inches and a uniform inner diameter of 2.0 inches. The outer diameter of these access conduits in accordance with the present invention linearly decreased from a maximum of 2.092 inches proximate to the container outer shell to a minimum of 2.04 inches proximate to the inner vessel. Thus, the wall thickness of the access conduit was gradually reduced in a linear maner from a point along the length of the access conduit proximate to the juncture of the access conduit with the outer shell to a point along the length of the access conduit proximate to the juncture of the access conduit with the inner vessel in accordance with the present invention.

The NER for the containers in accordance with the present invention was determined in the same manner as the NER for the prior art containers of Example I. Each of the containers in accordance with the present invention was filled with liquid nitrogen and the NER was measured as in Example I. The results of this NER testing for the containers in accordance with the present invention are tabulated in Table II. One of the containers (container 2) in accordance with the present invention was not tested for its NER due to a manufacturing defect. A joint leak prevented the container from maintaining the proper vacuum in the evacuable space between the inner vessel and the outer shell required for the high quality thermally insulated container for which the access conduit in accordance with the present invention is adapted for use. Container 3 was removed for structural testing after measurement of the second NER.

TABLE II

| (Present Invention) NER Performance Containers In Accordance with the Present Invention | | | | |
|---|---|---|---|---|
| Container No. | 1st NER Over 3 Days (lbs/day) | 2nd NER Over 3 Days (lbs/day) | 3rd NER Over 3 Days (lbs/day) | 4th NER Over 3 Days (lbs/day) |
| 1 | 0.1833 | 0.1767 | 0.1767 | 0.1627 |
| 2 | Not tested for NER - manufacturing defect. | | | |
| 3 | 0.1867 | 0.1933 | — | — |
| 4 | 0.1833 | 0.1833 | 0.1833 | 0.1652 |
| Average | 0.1844 | 0.1844 | 0.1800 | 0.1640 |

The average NER over the entire test was 0.1794 lbs/day for the containers in accordance with the present invention. The average holding time for the containers in accordance with the present invention is 288 days.

A comparison of the average NER's for the containers in accordance with the present invention (Table II) and the prior art containers (Table IB) clearly demonstrates the superior performance of a container having an access conduit in accordance with the present invention. The overall average NER improvement for a container having an access conduit in accordance with the present invention is approximately 12 percent better relative to the prior art containers. This improvement is especially note worthy when it is considered that the prior art containers had a highly efficient, high quality insulation (as did the containers in accordance with the present invention), and that a significant NER improvement has been obtained by the container in accordance with the present invention in a structurally simple, economical manner.

After the NER testing, all four of the containers having the access conduit in accordance with the present invention were tested for structural integrity by "slam-testing." In a slam-test (which is used in the art for testing cryogenic container structural integrity), the container to be tested is accelerated into an immobile barrier from a fixed incline distance. Each container was first tested four times at a distance of 56 inches up a 10 degree incline which is the present commercial standard. The distance was then systematically increased in increments of 12 inches and the containers in accordance with the present invention were retested with four impacts each at each increment.

In container 1, the access conduit, in accordance with the present invention, did not fail until the fourth impact or slam at 80 inches up the inclined distance. Containers 2 and 3 were both removed from testing after surviving slam-testing at 80 inches up the incline and 104 inches up the incline, respectively, without failure. The access conduit in accordance with the present invention of container 4 failed during the third slam-test at 92 inches up the decline.

The foregoing tests clearly demonstrate that the containers in accordance with the present invention more than exceed the current commercial standards for structural integrity.

Accordingly, these tests demonstrates that the containers in accordance with the present invention significantly improve the NER of a cryogenic container having a high quality thermal insulation system in a structurally simple, economical manner without impairing the structural integrity of the container.

It should be noted that the access conduit in accordance with the present invention is particularly adapted for use with a high quality thermal insulation in evacuable spaces with vacuum pressures of less than 0.1 microns ($1\times10^{-6}$ m.) mercury. Composite multilayered insulations are particularly suitable.

Unless a high quality insulation is used and a low pressure is maintained in the insulation space (i.e., the container has a high performance insulation system), the main advantage of the present invention is reduced in significance. This is because the reduction of heat inflow through the access conduit is overshadowed by heat inflow through the insulation system.

For example, in a typical double-walled thermally insulated container employing a particulate vacuum insulation such as perlite, the heat inflow through a plastic access conduit is only on the order of about 0.5 percent of the total heat inflow into the container inner vessel. That is, the heat inflow through the particulate perlite insulation substantially outweighs the heat inflow through the access conduit.

An access conduit in accordance with the present invention may typically provide about a 23 percent raduction in actual heat inflow through a stainless steel access conduit relative to a prior art stainless steel cylindrical access conduit.

In accordance with one embodiment of the present invention, the access conduit has a variable wall thickness with the minimum cross sectional area in a plane perpendicular to the longitudinal axis of the access conduit substantially coinciding with the point of minimum bending moment along the length of the conduit.

Although preferred embodiments of the present invention have been described in detail, it is contemplated that modifications may be made and that some features may be employed without others, all within the spirit and scope of the invention.

What is claimed is:

1. A vacuum insulated cryogenic container comprising:

an inner vessel for holding a cryogenic liquid, said inner vessel having an access opening;

an outer shell enclosing said inner vessel in a spaced apart relationship so as to form an evacuable space therebetween, said outer shell having an access opening disposed substantially in alignment with said access opening of said inner vessel;

thermal insulation material disposed in said evacuable space; and an access conduit joining said access opening of said outer shell to said access opening of said inner shell such that said inner vessel is supported within the outer shell in said spaced apart relationship by said access conduit; wherein said access conduit is an elongated body having a substantially constant inside diameter of cylindrical configuration and a variable outside diameter which decreases linearly in dimension within said evacuable space to form a gradual taper from a point proximate to the juncture of said access conduit with said outer shell to a point proximate the juncture of said access conduit with said inner vessel, said variable outside diameter of said access conduit decreases linearly such that the ratio of stress in said conduit due to bending moment to said strength of said conduit material is substantially constant along the length of said conduit within said evacuable space between said two juncture points, said access conduit being composed of a material whose strength increases with decreasing temperature.

* * * * *